US009420936B2

(12) United States Patent
Tarr

(10) Patent No.: US 9,420,936 B2
(45) Date of Patent: Aug. 23, 2016

(54) DISHWASHER APPLIANCE AND A SPRAY ASSEMBLY FOR THE

(71) Applicant: General Electric Company, Schenectady, NY (US)

(72) Inventor: Ronald Scott Tarr, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 854 days.

(21) Appl. No.: 13/739,268

(22) Filed: Jan. 11, 2013

(65) Prior Publication Data

US 2014/0196755 A1 Jul. 17, 2014

(51) Int. Cl.
*A47L 15/20* (2006.01)

(52) U.S. Cl.
CPC ..... *A47L 15/20* (2013.01)

(58) Field of Classification Search
CPC ..... B08B 3/02; B08B 3/022; B08B 3/024; B60S 3/04; A47L 15/23
USPC ..... 134/172, 181, 167 R, 200, 123, 199, 134/144, 198, 72; 239/227, 251, 264, 752, 239/751, 247; 15/302, 309.2, 306.1, 322
See application file for complete search history.

(56) References Cited

U.S. PATENT DOCUMENTS 4,170,240 A * 10/1979 Gentry ..... B08B 3/02 134/104.4
7,959,744 B2 6/2011 Sundaram et al.
2003/0111099 A1* 6/2003 Anderson ..... B60S 3/04 134/113

* cited by examiner

*Primary Examiner* — David Cormier
*Assistant Examiner* — Thomas Bucci
(74) *Attorney, Agent, or Firm* — Dority & Manning, P.A.

(57) ABSTRACT

A dishwasher appliance and a spray assembly for the same are provided. The spray assembly includes a spray body and features for moving the spray body within a wash chamber of the dishwasher appliance. Wash fluid coverage within the wash chamber can be improved by moving the spray body within the wash chamber.

10 Claims, 7 Drawing Sheets

FIG. —1—

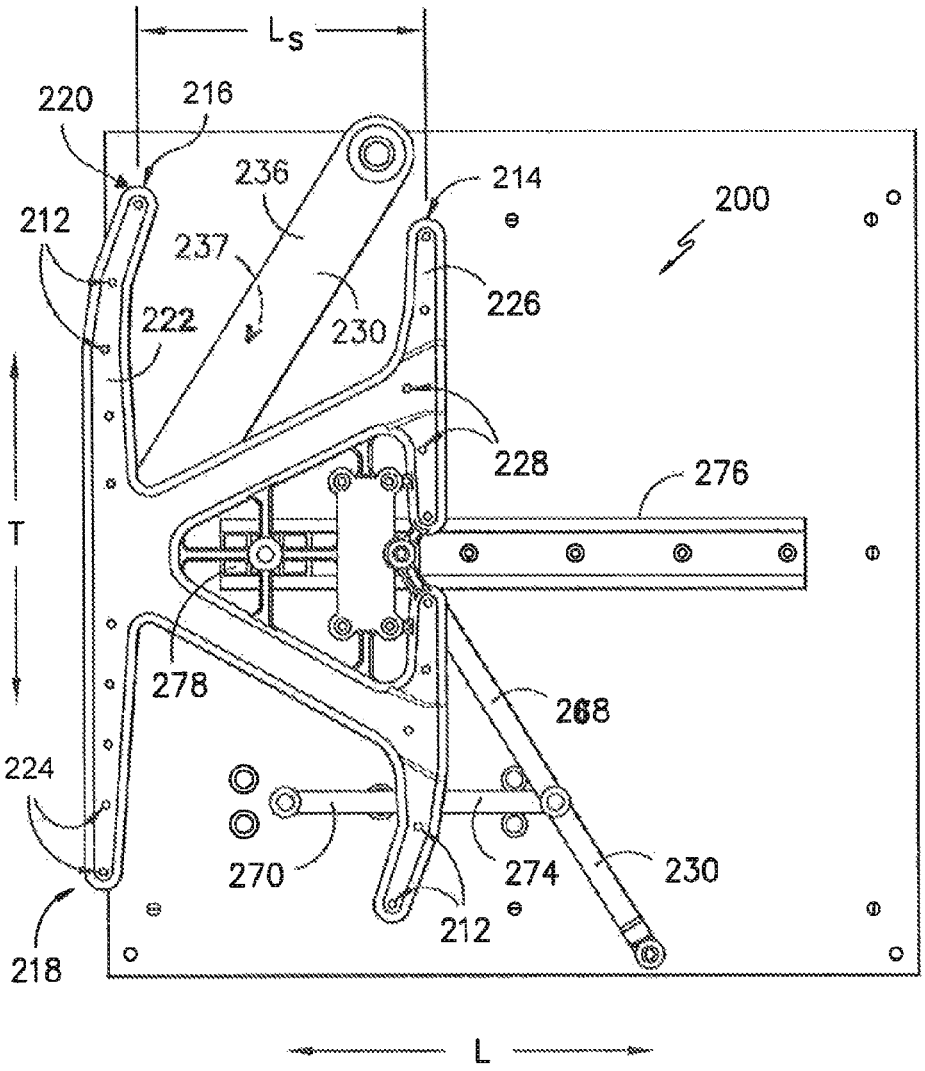
FIG. —5—

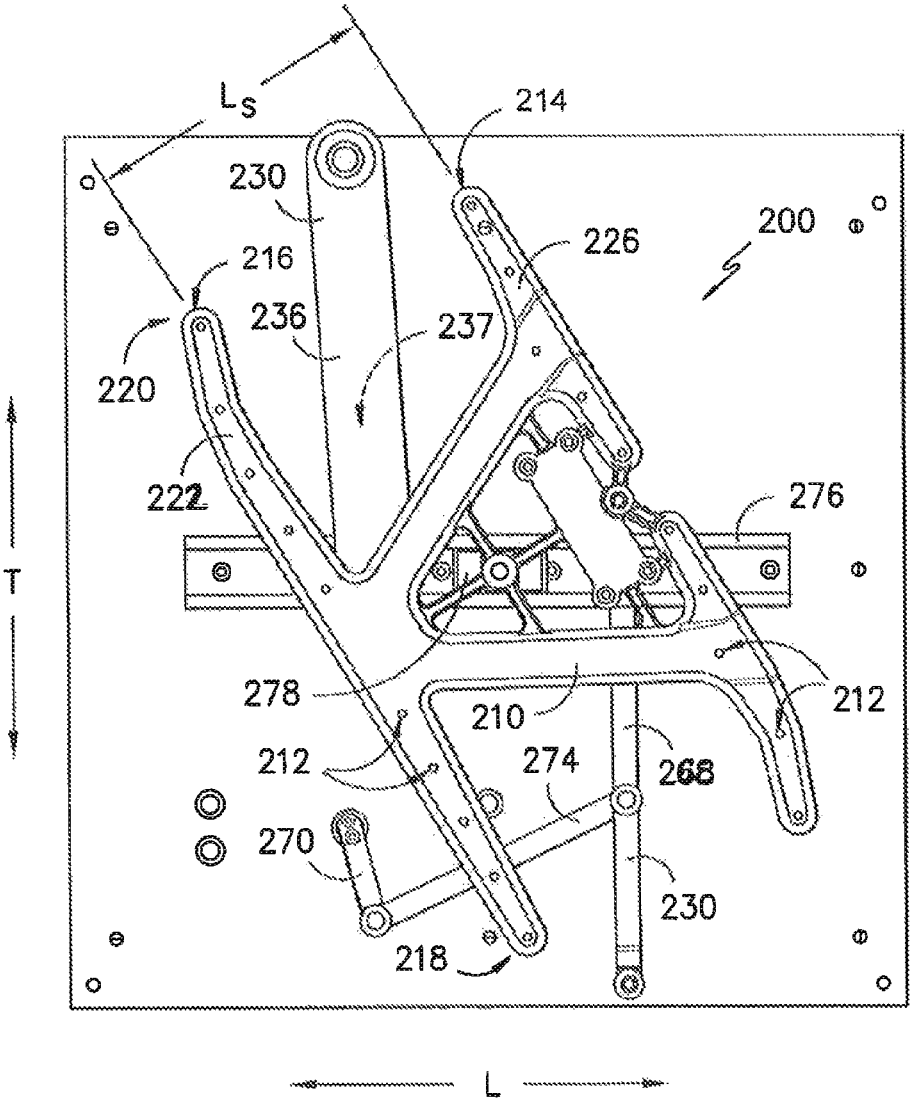
FIG. —6—

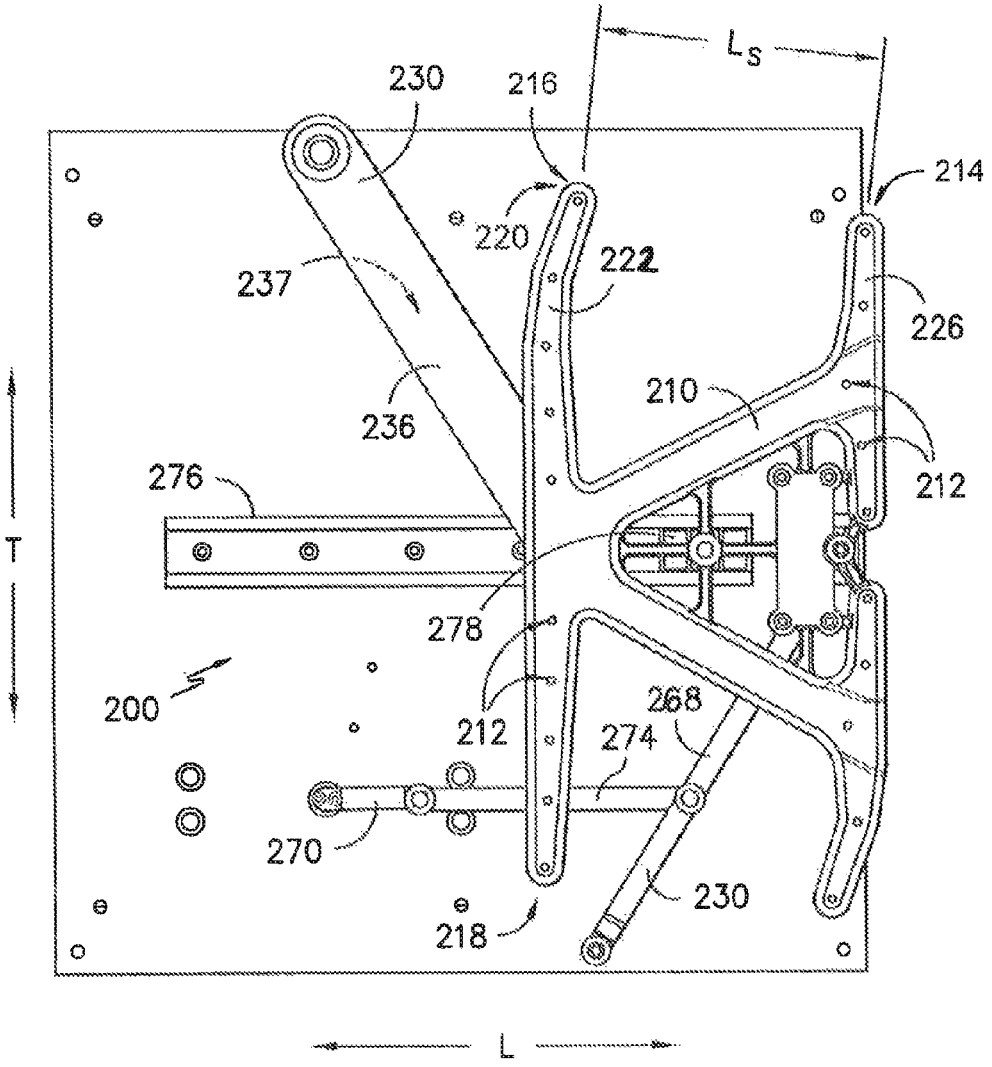
FIG. —7—

DISHWASHER APPLIANCE AND A SPRAY ASSEMBLY FOR THE

FIELD OF THE INVENTION

The present subject matter relates generally to dishwasher appliances and spray assemblies for the same.

BACKGROUND OF THE INVENTION

Dishwasher appliances generally include a tub that defines a wash chamber for receipt of articles for washing. In particular, certain dishwasher assemblies include a rack assembly slidably mounted within the wash chamber for receipt of articles for washing. A user can load articles, such as plates, bowls, and/or cups, into the rack assembly, and the rack assembly can support such articles within the wash chamber during operation of the dishwasher appliance.

Certain dishwasher appliances include a spray arm for directing wash fluid onto articles within the wash chamber during operation of the dishwasher appliance. Spray arms are generally rotatably mounted with the wash chamber in order to improve wash fluid coverage of articles within the wash chamber. During rotation, spray arms generally define a circular spray area. However, wash chambers generally have a rectangular or square cross-section. Thus, it can be difficult to direct wash fluid towards corners of the wash chamber with rotating spray arms.

To improve wash fluid coverage within the wash chamber's corners, certain spray arms include outlets directed towards the wash chamber's corners. However, wash fluid directed out of such outlets can impact the dishwasher appliance's tub and generate unappealing or undesirable noise. Further, wash fluid directed in such a manner often provides poor or uneven coverage and can lead to inconsistent cleaning of articles located within the wash chamber's corners.

Accordingly, a spray assembly for a dishwasher appliance with features for improving spray coverage within a wash chamber of the dishwasher appliance would be useful. In particular, a spray assembly for a dishwasher appliance with features for improving spray coverage within corners of a wash chamber would be useful.

BRIEF DESCRIPTION OF THE INVENTION

The present subject matter provides a dishwasher appliance and a spray assembly for the same. The spray assembly includes a spray body and features for moving the spray body within a wash chamber of the dishwasher appliance. Wash fluid coverage within the wash chamber can be improved by moving the spray body within the wash chamber. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub that defines a wash chamber and a rack assembly slidably positioned within the wash chamber of the tub. The rack assembly is configured for receipt of articles for washing. A spray assembly is mounted within the wash chamber of the tub and is also configured for directing a spray of wash fluid towards the rack assembly. The spray assembly defines a lateral direction. The spray assembly includes a spray body and a pair of links. Each link of the pair of links is rotatably mounted to the tub and the spray body. A crank is configured for rotation about an axis of rotation. A coupler is rotatably mounted to one of the pair of links and the crank such that the coupler extends between and connects the crank and the one of the pair of links. The spray body moves along the lateral direction when the crank rotates about the axis of rotation.

In a second exemplary embodiment, a spray assembly for a dishwasher appliance is provided. The spray assembly defines a lateral direction and a transverse direction. The spray assembly includes a spray body having a first lateral side portion and a second lateral side portion spaced apart from each other along the lateral direction. The spray body also has a first transverse side portion and a second transverse side portion spaced apart from each other along the transverse direction. A link is positioned proximate the second transverse side portion of the spray body and is rotatably mounted to the spray body at the second lateral side portion of the spray body. A rocker is positioned proximate the first transverse side portion of the spray body and is rotatably mounted to the spray body at the first lateral side portion of the spray body. A crank is configured for rotation about an axis of rotation. A coupler is rotatably mounted to the rocker and the crank such that the coupler extends between and connects the crank and the rocker. The spray body moves along the lateral direction when the crank rotates about the axis of rotation.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIGS. 5-7 provide plan views of the spray assembly of FIG. 3 with a spray body of the spray assembly shown in various positions.

DETAILED DESCRIPTION

Figure 1:
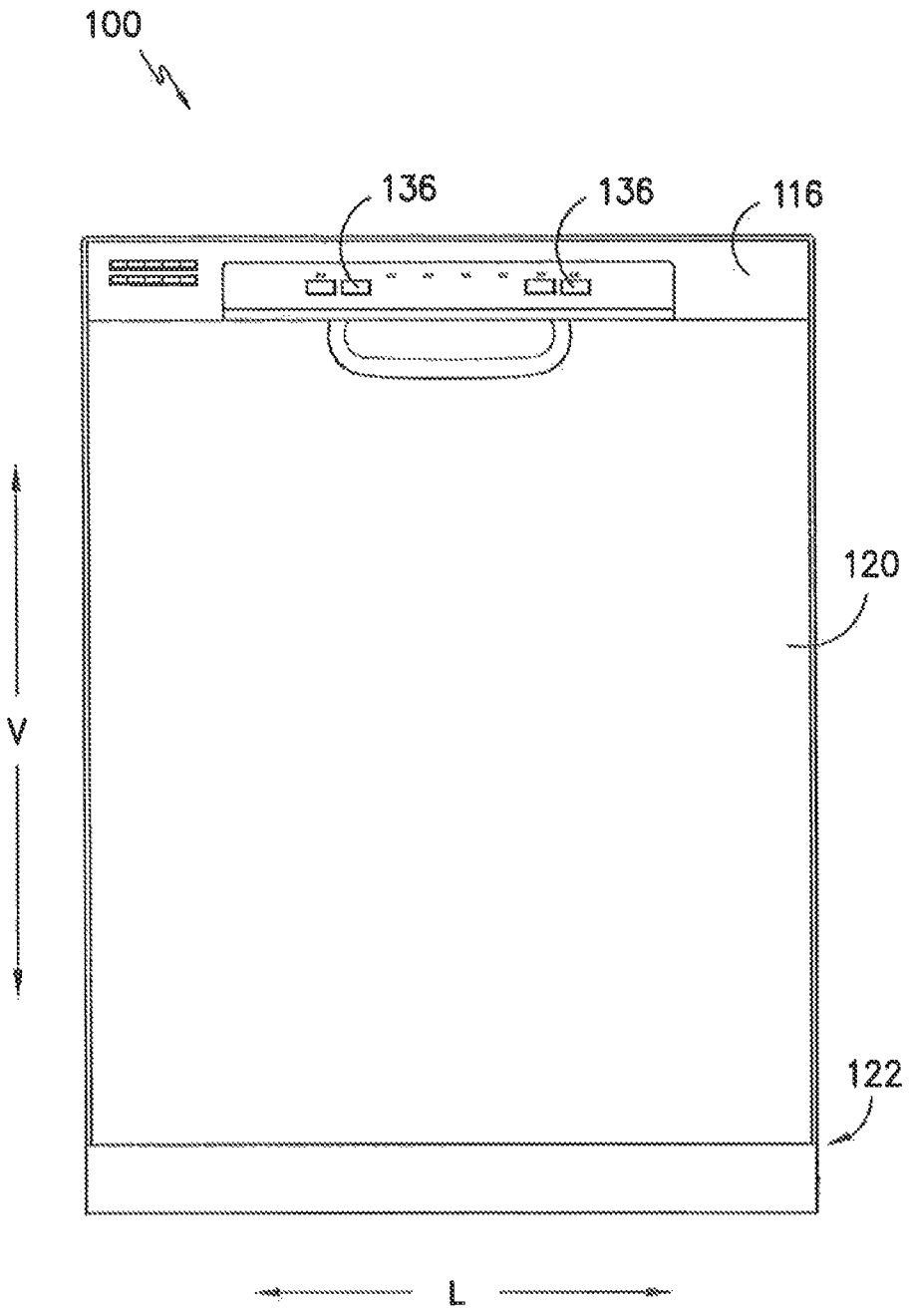
FIG. 1 provides a front, elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
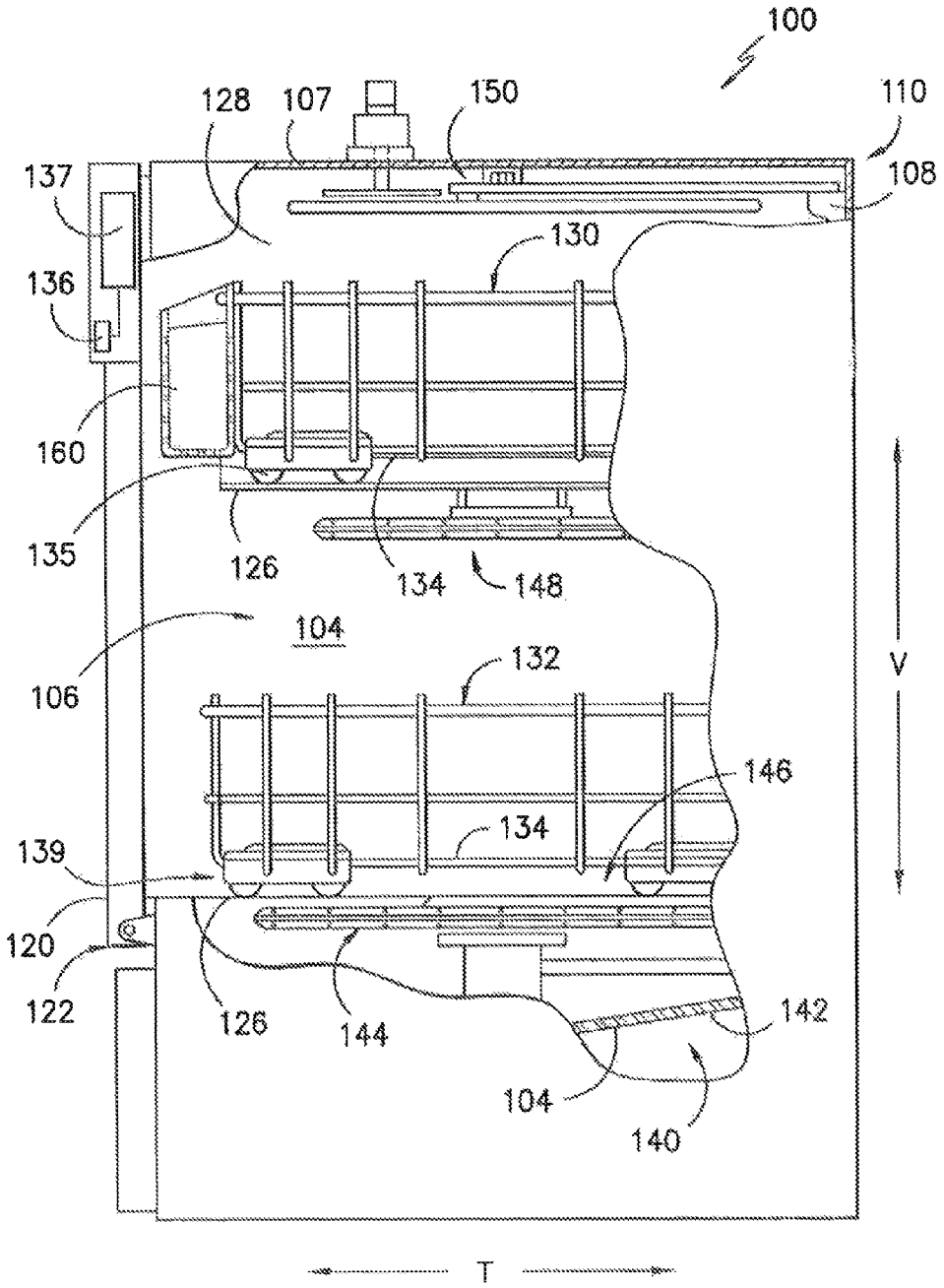
FIG. 2 provides a side, partial section view of the dishwasher appliance of FIG. 1 and reveals a wash chamber of the dishwasher appliance.

FIG. 1 provides a front, elevation view of a dishwasher appliance 100 according to an exemplary embodiment of the present subject matter. FIG. 2 provides a side, partial section view of dishwasher appliance 100 and reveals a wash chamber or compartment 106 of dishwasher appliance 100. Dishwasher appliance 100 defines a vertical direction V, a lateral direction L, and a transverse direction T. Vertical direction V, lateral direction L, and transverse direction T are mutually perpendicular and form an orthogonal directional system. It should be understood that the orientation of the lateral direction L and transverse direction T shown in FIGS. 1 and 2 is provided by way of example only. Thus, in alternative exemplary embodiments, the transverse direction T and lateral direction L may be switch or inverted relative to each other.

Dishwasher appliance 100 includes a tub 104 that defines wash compartment 106. In particular, tub 104 includes a top wall 107 that assists in defining wash compartment 106. Tub 104 also includes a door 120 hinged at its bottom 122 for movement between a normally closed configuration (shown in FIGS. 1 and 2) in which wash compartment 106 is sealed shut, e.g., for washing operation, and an open configuration, e.g., for loading and unloading of articles from dishwasher appliance 100.

Turning to FIG. 2, guide rails 126 are mounted on tub side walls 128 and accommodate upper and lower roller-equipped rack assemblies 130, 132. Each of the upper and lower racks assemblies 130, 132 is fabricated from lattice structures that include a plurality of wires or elongated members 134. Each rack assembly 130, 132 is adapted for movement between an extended loading position (not shown) in which the rack assembly is substantially positioned outside the wash compartment 106, and a refracted position (shown in FIGS. 1 and 2) in which the rack assembly is located inside the wash compartment 106.

A silverware basket 160 is removably mounted to upper rack assembly 130. However, silverware basket 160 may also be selectively attached to other portions of dishwasher appliance 100, e.g., lower rack assembly 132 or door 120. Silverware rack 160 is configured for receipt of silverware, utensils, and the like, that are too small to be accommodated by the upper and lower racks assemblies 130, 132.

The dishwasher appliance 100 further includes a lower spray assembly 144 that is mounted within a lower region 146 of the wash compartment 106 and above a tub sump portion 142 so as to be in relatively close proximity to the lower rack assembly 132. A mid-level spray assembly 148 is located in an upper region of the wash compartment 106 and may be located in close proximity to upper rack assembly 130. Additionally, an upper spray assembly 150 is located above the upper rack assembly 130 and mounted to top wall 107 of tub 104.

The lower and mid-level spray assemblies 144, 148 and the upper spray assembly 150 are fed by a fluid circulation assembly (not shown) for circulating water and wash fluid (e.g., detergent, water, and/or rinse aid) in the tub 104. The fluid circulation assembly may be located in a machinery compartment 140 located below the bottom sump portion 142 of the tub 104, as generally recognized in the art. The fluid circulation assembly includes circulation piping 108 that directs water and/or wash fluid to upper spray assembly 150.

Each spray assembly includes an arrangement of discharge ports or orifices for directing wash fluid onto dishes or other articles located in the upper and lower rack assemblies 130, 132 and silverware basket 160. The lower, mid-level, and upper spray assemblies 144, 148, and 150 may be rotatably mounted in wash compartment 106. Accordingly, the arrangement of the discharge ports in at least the lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 137 may be positioned in a variety of locations throughout dishwasher appliance 100. In the illustrated embodiment, controller 137 is located within a control panel 116 of door 120. Input/output ("I/O") signals may be routed between the control system and various operational components of dishwasher appliance 100 along wiring harnesses that may be routed through the bottom 122 of door 120. Typically, controller 137 includes a user interface panel 136 through which a user may select various operational features and modes and monitor progress of the dishwasher appliance 100. In one exemplary embodiment, user interface 136 represents a general purpose I/O ("GPIO") device or functional block. In another exemplary embodiment, user interface 136 includes input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication with controller 137 via one or more signal lines or shared communication busses.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations.

Figure 3:
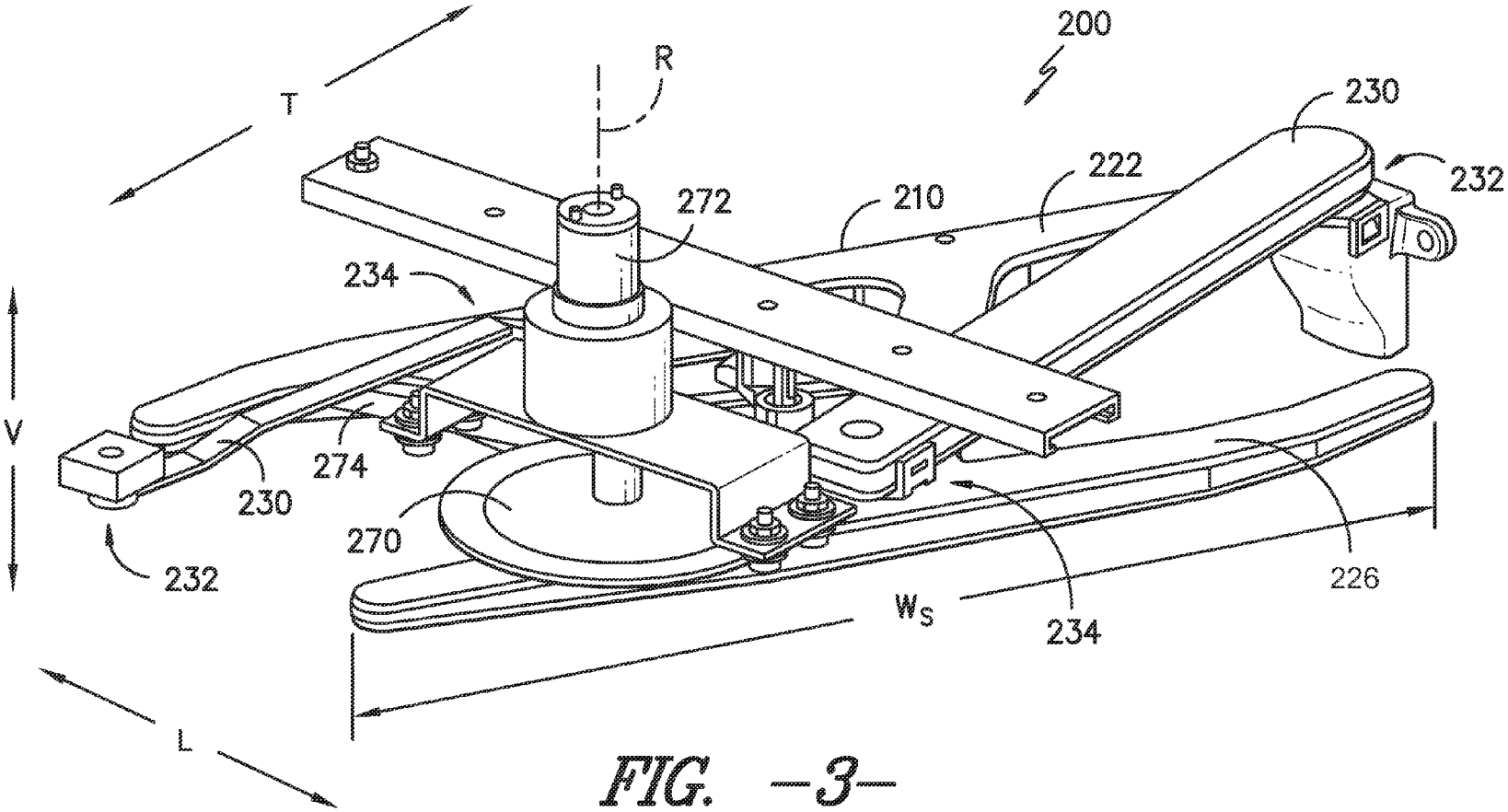
FIG. 3 provides a perspective view of a spray assembly according to an exemplary embodiment of the present subject matter.
Figure 4:
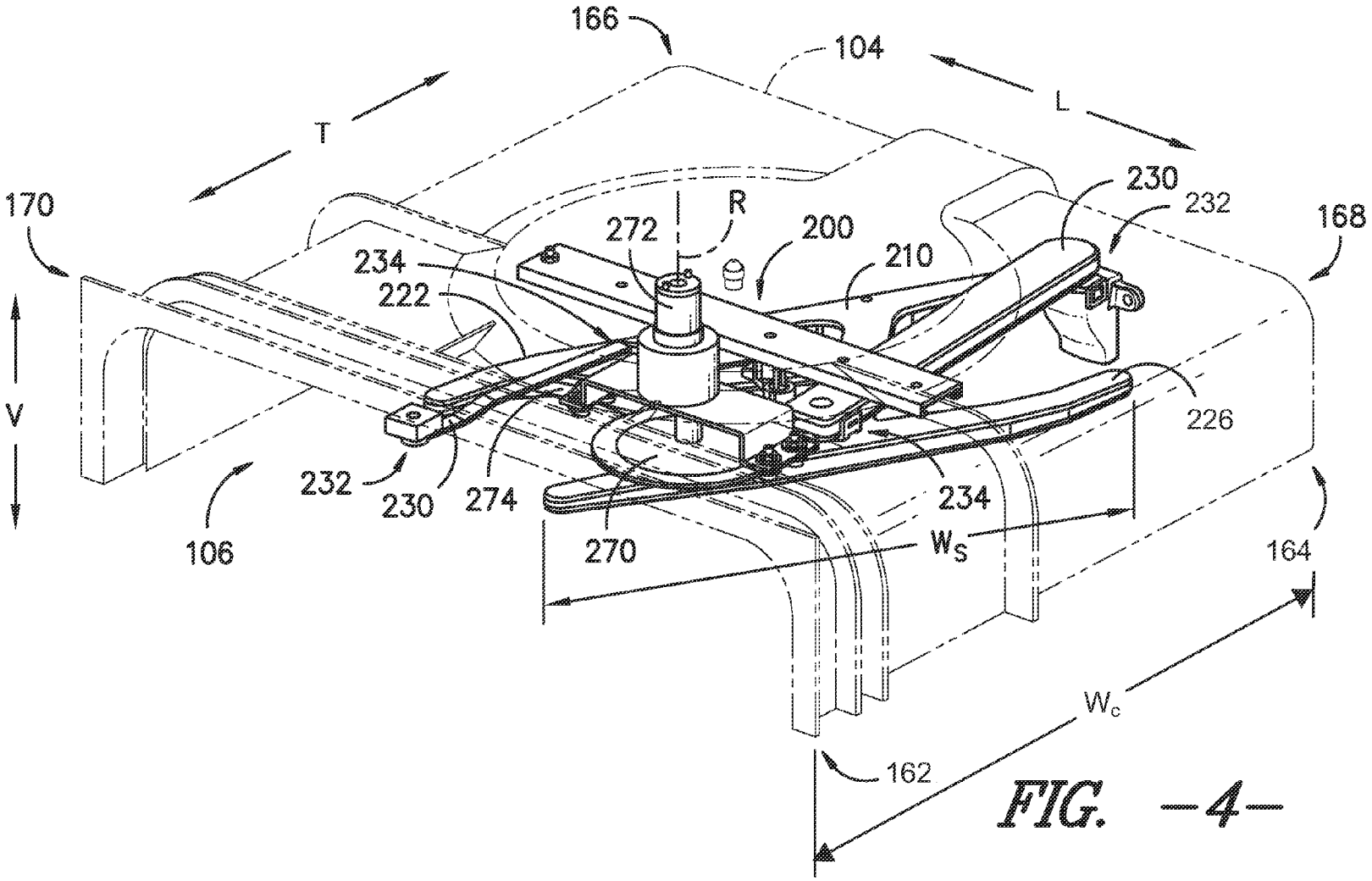
FIG. 4 provides a perspective view of the spray assembly of FIG. 3 mounted within the wash chamber of the dishwasher appliance of FIG. 2.

FIG. 3 is a perspective view of a spray assembly 200 according to an exemplary embodiment of the present subject matter. FIG. 4 provides a perspective view of spray assembly 200 mounted within wash compartment 106 of dishwasher appliance 100. In particular, spray assembly 200 is positioned at a top portion 170 of wash compartment 106, e.g., such that spray assembly is positioned above upper rack assembly 130 (FIG. 2) along the vertical direction V. However, it should be understood that spray assembly 200 may be utilized as mid-level spray assembly 148 and/or lower spray assembly 144 (FIG. 2) in alternative exemplary embodiments. Further, spray assembly 200 may be utilized in any suitable dishwasher appliance in alternative exemplary embodiments.

Spray assembly 200 includes a spray body 210. Spray body 210 is configured for moving, e.g., linearly, within wash compartment 106 of dishwasher appliance 100, e.g., along the lateral direction L. In FIGS. 3 and 4, spray body 210 is in about the orientation shown in FIG. 6. However, it should be understood that spray body 210 can also adjust to the orientations shown in FIGS. 5 and 7 during motion of spray body 210 within wash compartment 106. Movement of spray body 210 is discussed in greater detail below.

Spray body 210 is configured for receipt of wash fluid and for directing such wash fluid, e.g., towards articles for washing within wash compartment 106. In particular, spray body 210 defines a plurality of outlets 212 (FIG. 5). Outlets 212 can direct wash fluid out of spray body 210, e.g., towards upper rack assembly 130 (FIG. 2).

As shown in FIG. 3, spray body 210 has a width $W_S$, e.g., between opposite, transverse sides of spray body 210. Similarly, as shown in FIG. 4, wash compartment 106 of tub 104 has a width $W_C$, e.g., between opposite, transverse sides of wash compartment 106. In various exemplary embodiments, width $W_S$ may be about equal to width $W_C$. For example, width $W_C$ may be about ninety-five, ninety, eighty, or seventy-five percent of width $W_S$. Thus, spray body 210 can span across wash compartment 106 of tub 104, e.g., along the transverse direction T.

In the exemplary embodiment shown in FIG. 3, spray body 210 includes a first spray arm 222 and a second spray arm 226. First and second spray arms 222 and 226 are spaced apart from each other, e.g., along the lateral direction L. First spray arm 222 defines a first set of outlets 224 (FIG. 5). Similarly, second spray arm 226 defines a second set of outlets 228 (FIG. 5). First and second set of outlets 224 and 228 are configured for directing wash fluid out of first and second spray arms 222 and 226, respectively.

Spray assembly 200 also includes a pair of links 230. As shown in FIG. 4, each link of links 230 is rotatably mounted to both tub 104 and spray body 210. Links 230 are spaced apart from each other, e.g., along the transverse direction T, such that links 230 are positioned on opposite sides of wash compartment 106 within tub 104. In particular, each link of links 230 extends between a first end portion 232 and a second end portion 234. First end portions 232 of links 230 are rotatably mounted to tub 104 at opposite, transverse sides of wash compartment 106 of tub 104. In addition, second end portions 234 of links 230 are rotatably mounted to spray body 210 at opposite, lateral side portions of spray body 210. Thus, first end portions 232 of links 230 are spaced apart from each other, e.g., along the transverse direction T, and second end portions 234 of links 230 are spaced apart from each other, e.g., along the lateral direction L.

Spray assembly 200 also includes a crank 270 that is configured for rotation about an axis of rotation R, e.g., that extends along the vertical direction V. In particular, a motor 272 is in mechanical communication with crank 270 and is configured for rotating crank 270 about the axis of rotation R. As an example, crank 270 may be directly mounted to a shaft of motor 272. As another example, suitable gearing can couple motor 272 and crank 270, e.g., such that rotational motion of motor 272 is transferred to crank 270. Motor 272 can rotate crank 270 about the axis of rotation R at any suitable rate, e.g., at about six rotations per minute.

A connector or coupler 274 is rotatably mounted to one of links 230 and to crank 270. Thus, coupler 274 extends between and connects crank 270 and the one of links 230. Thus, motion of crank 270 can be transferred to the one of links 230 and, in turn, to spray body 210 via coupler 274. In particular, spray body 210 moves, e.g., linearly, along the lateral direction L when crank 270 rotates about the axis of rotation R as discussed in greater detail below.

Wash spray coverage of spray body 210 within wash compartment 106 can be improved because spray body 210 moves along the lateral direction L. In particular, wash compartment 106 of tub 104 extends between a left side portion 166 and a right side portion 168, e.g., along the lateral direction L, and spray body 210 may be mounted such that spray body 210 moves between left side portion 166 of wash compartment 106 and right side portion 168 of wash compartment 106, e.g., along lateral direction L. By moving between, left and right side portions 166 and 168, spray body 210 can apply wash fluid uniformly along the lateral direction L within wash compartment 106 and thereby improve wash fluid coverage within wash compartment 106.

In alternative exemplary embodiments, spray assembly 200 may be oriented in any suitable manner within wash compartment 106. In particular, wash compartment 106 of tub 104 extends between a front portion 162 and a back portion 164, e.g., along the transverse direction T, and spray body 210 may be mounted such that spray body 210 moves between front portion 162 of wash compartment 106 and back portion 164 of wash compartment 106, e.g., along transverse direction T. However, as discussed above, the lateral direction L and transverse direction T may be switched or inverted relative to each other. Thus, spray body 210 can move between front and back portions 162 and 164 of wash compartment 106 along the lateral direction L.

FIGS. 5-7 provide plan views of spray assembly 200 with spray body 210 of spray assembly 200 shown in various positions. As may be seen in FIGS. 5-7, spray body 210 has a first lateral side portion 214 and a second lateral side portion 216. First and second lateral side portions 214 and 216 are spaced apart from each other along the lateral direction L. Spray body 210 has a length $L_S$, e.g., between first lateral side portion 214 and second lateral side portion 216. Length $L_S$ can be any suitable distance. For example, length $L_S$ can be greater than about four inches, greater than about five inches, greater than about six inches, or greater than about seven inches. Spray body 210 also has a first transverse side portion 218 and a second transverse side portion 220. First and second transverse side portions 218 and 220 are spaced apart from each other along the transverse direction T.

Links 230 include a water link 236 and a rocker 238. Water link 236 is positioned proximate or at second transverse side portion 220 of spray body 210. Further, water link 236 is rotatably mounted to spray body 210 at second lateral side portion 216 of spray body 210. Conversely, rocker 238 is positioned proximate or at first transverse side portion 218 of spray body 210, Further, rocker 238 is rotatably mounted to spray body 210 at first lateral side portion 214 of spray body 210.

Water link 236 is configured for supplying wash fluid to spray body 210. In particular, water link 236 defines a passage 237 therein. Passage 237 of water link 236 is configured for directing a flow of wash fluid into spray body 210. In turn, outlets 212 of spray body 210 can direct the flow of wash fluid out of spray body 210.

As discussed above, crank 270 is configured for rotation about the axis of rotation R (FIG. 3). Coupler 274 is rotatably mounted to rocker 238 and crank 270 such that coupler 274 extends between and connects crank 270 and rocker 238. Further, spray body 210 moves along the lateral direction L when crank 270 rotates about the axis of rotation R.

In particular, when crank 270 rotates about the axis of rotation R, spray body 210 can move between the various positions shown in FIGS. 5-7, For example, from the position shown in FIG. 5, motor 272 (FIG. 3) can rotate crank 270, Rotational motion of crank 270 can move coupler 274 that, in turn, pushes rocker 238 and spray body 210 towards the position shown in FIG. 6. Continued rotation of crank 270 can move spray body 210 from the position shown in FIG. 6 to the position shown in FIG. 7. Further, as crank 270 continues to rotate, spray body 210 can return to the position shown in FIG. 5 from the position shown in FIG. 7, Thus, rotation of crank 270 can shift spray body 210 from the position shown in FIG. 5 to the position shown in FIG. 7 and vice versa. Such movement of spray body 210 can improve wash fluid coverage within wash compartment 106 as discussed above.

Spray assembly 200 also includes a rail 276, e.g., mounted to tub 104. Rail 276 extends along the lateral direction L, and spray body 210 is slidably mounted to rail 276. In particular, spray body 210 includes a carriage 278 that is slidably received within rail 276. Rail 276 can assist within hindering downward movement of spray body 210, e.g., along the vertical direction V (FIG. 3), when spray body 210 is full of wash fluid and heavy. Thus, spray body 210 can hang from rail 276.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub that defines a wash chamber;

a rack assembly slidably positioned within the wash chamber of said tub and configured for receipt of articles for washing;

a spray assembly mounted within the wash chamber to a top wall of said tub and configured for directing a spray of wash fluid towards said rack assembly, said spray assembly defining a lateral direction, said spray assembly comprising a spray body;

a pair of links, each link of said pair of links rotatably mounted to said tub and said spray body, said pair of links comprising a water link that is configured for supplying wash fluid to said spray body, said spray body defining a plurality of outlets for directing wash fluid towards said rack assembly;

a crank configured for rotation about an axis of rotation; and a coupler rotatably mounted to one of said pair of links and said crank such that said coupler extends between and connects said crank and the one of said pair of links;

wherein said spray body moves along the lateral direction when said crank rotates about the axis of rotation.

2. The dishwasher appliance of claim 1, wherein said spray assembly defines a transverse direction that is perpendicular to the lateral direction, each link of said pair of links extending between a first end portion and a second end portion, the first end portions of said pair of links rotatably mounted to said tub at opposite, transverse sides of the wash chamber of said tub.

3. The dishwasher appliance of claim 2, wherein the second end portions of said pair of links are rotatably mounted to said spray body at opposite, lateral side portions of said spray body.

4. The dishwasher appliance of claim 2, wherein the first end portions of said pair of links are spaced apart from each other along the transverse direction.

5. The dishwasher appliance of claim 2, wherein the second end portions of said pair of links are spaced apart from each other along the lateral direction.

6. The dishwasher appliance of claim 1, wherein said spray assembly defines a transverse direction that is perpendicular to the lateral direction, the links of said pair of links being spaced apart from each other along the transverse direction.

7. The dishwasher appliance of claim 1, wherein said spray assembly further comprises a motor in mechanical communication with said crank, said motor configured for rotating said crank about the axis of rotation.

8. The dishwasher appliance of claim 1, wherein said spray assembly further comprises a rail mounted to said tub and extending along the lateral direction, said spray body slidably mounted to said rail.

9. The dishwasher appliance of claim 1, wherein said spray body includes a first spray arm and a second spray arm spaced apart from each other along the lateral direction.

10. The dishwasher appliance of claim 1, wherein the wash chamber of said tub extends between a top portion and a bottom portion, said spray assembly positioned at the top portion of the chamber and also positioned above said rack assembly.

* * * * *